US008511725B1

(12) United States Patent
Reaves

(10) Patent No.: US 8,511,725 B1
(45) Date of Patent: Aug. 20, 2013

(54) DOOR SECURITY DEVICE

(76) Inventor: John K. Reaves, College Park, GA (US)

( * ) Notice: Subject to any disclaimer, the term of this patent is extended or adjusted under 35 U.S.C. 154(b) by 351 days.

(21) Appl. No.: 13/006,732

(22) Filed: Jan. 14, 2011

(51) Int. Cl.
*E05C 19/00* (2006.01)

(52) U.S. Cl.
USPC ..... 292/302; 292/162; 292/145

(58) Field of Classification Search
USPC ..... 292/302, 162, 175, 145
See application file for complete search history.

(56) References Cited

U.S. PATENT DOCUMENTS 2,717,064 A * 9/1955 Hock ..... 49/394
4,227,724 A * 10/1980 Day ..... 292/145
4,341,408 A * 7/1982 Blevins ..... 292/150
4,763,499 A 8/1988 Boyle
5,076,626 A 12/1991 Tiddy et al.
5,269,100 A 12/1993 Fontenot
6,691,466 B2 2/2004 Childress
2005/0011132 A1 1/2005 Griffin, Jr.

* cited by examiner

*Primary Examiner* — Carlos Lugo
*Assistant Examiner* — Mark Williams
(74) *Attorney, Agent, or Firm* — Benjamin A. Balser; Balser & Grell IP Law

(57) ABSTRACT

The door security device provides a trim and a track, the trim further having a plurality of spaced apart male tabs, each male tab having a horizontal connected to a downwardly disposed vertical, the track further having a plurality spaced apart female tabs, each female tab having a horizontal connected to an upwardly disposed vertical, the track fastened to an existing stud/jamb of an existing door, whereby the trim is engaged with the track via the tabs by moving the trim laterally with the trim remaining engaged with the track, the trim thereby blocking the opening of a door.

15 Claims, 6 Drawing Sheets

DOOR SECURITY DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Door security has been addressed in many ways. A lock or plurality of locks has been one approach to door security. The problems, keys, and difficulties associated therewith are well known. Numerous latches and locks are also problematic. Door and wall trim strength are also security issues. The present device provides a unique and especially convenient device for securing a door from the interior, without added key mechanisms or turned-latch or turned-lock mechanisms. The device provides multiple female and male lock tab engagements operated with only one movement of the trim.

FIELD OF THE INVENTION

The door security device relates to door latches and locks and more especially to a door security device that provides multiple lock tabs that are engaged and disengaged with only one movement of the trim to engage the track.

SUMMARY OF THE INVENTION

The general purpose of the door security device, described subsequently in greater detail, is to provide a door security device which has many novel features that result in an improved door security device which is not anticipated, rendered obvious, suggested, or even implied by prior art, either alone or in combination thereof.

To attain this, the door security device allows a user to selectively prevent a door from opening. A key feature of the device is that the plurality of male tabs and female tabs of the track and trim are selectively engaged with only one movement. The trim is selectively engaged with the track to lock a door from opening via that plurality of engagements. The trim may be totally removed or may only be positioned laterally as chosen. The security offered thereby is unique. Importantly, the track is secured to an existing stud/jamb to ensure integrity of the device lock capability. To gain entry, an invader would have to destroy either the door or the stud/jamb, as the device engages a door and jamb from top to bottom. Various means for engaging the trim with an existing door may be used.

Means may be motorized, operated by electronics, magnetic, or even the trim provided with a handle. A bend in the handle may enable a user to engage the device without conflict with an existing latch/lock mechanism, for example. Importantly, the device provides greater security than a plurality of locks and latches that might otherwise be typically used. A user need only slide the trim via the handle extension to engage the track and to block the door from opening by positioning the trim beyond the door edge. The door is thereby engaged from top to bottom and thereby provides far more security against opening than does a conventional lock mechanism, or even a plurality of same. Conversely, the user may use the handle to slide the trim back away from overlapping the door, thereby unlocking the door to allow opening.

More basic embodiments of the device see the track with all male tabs, and the trim with all female tabs, or the track with all female tabs and the trim with all male tabs. The ideal embodiment has each of the trim and track alternately fitted with male and female tabs. The tabs may be equidistantly disposed.

Not only is the device far more convenient than are typical existing latch/lock mechanisms, the device is also far less expensive and much more easily installed.

Thus has been broadly outlined the more important features of the improved door security device so that the detailed description thereof that follows may be better understood and in order that the present contribution to the art may be better appreciated.

An object of the door security device is to provide door security.

Another object of the door security device is to provide for blocking a door opening from top to bottom.

An object of the door security device is to provide multiple lock tabs that are engaged with only one movement.

Another object of the door security device is to provide multiple lock tabs that are disengaged with only one movement.

A further object of the door security device is to provide extreme door security by fastening into an existing door stud and jamb.

An added object of the door security device is to provide ease of operation.

These together with additional objects, features and advantages of the improved door security device will be readily apparent to those of ordinary skill in the art upon reading the following detailed description of presently preferred, but nonetheless illustrative, embodiments of the improved door security device when taken in conjunction with the accompanying drawings.

DETAILED DESCRIPTION OF THE DRAWINGS

With reference now to the drawings, and in particular FIGS. 1 through 6 thereof, the principles and concepts of the door security device generally designated by the reference number 10 will be described.

Figure 1:
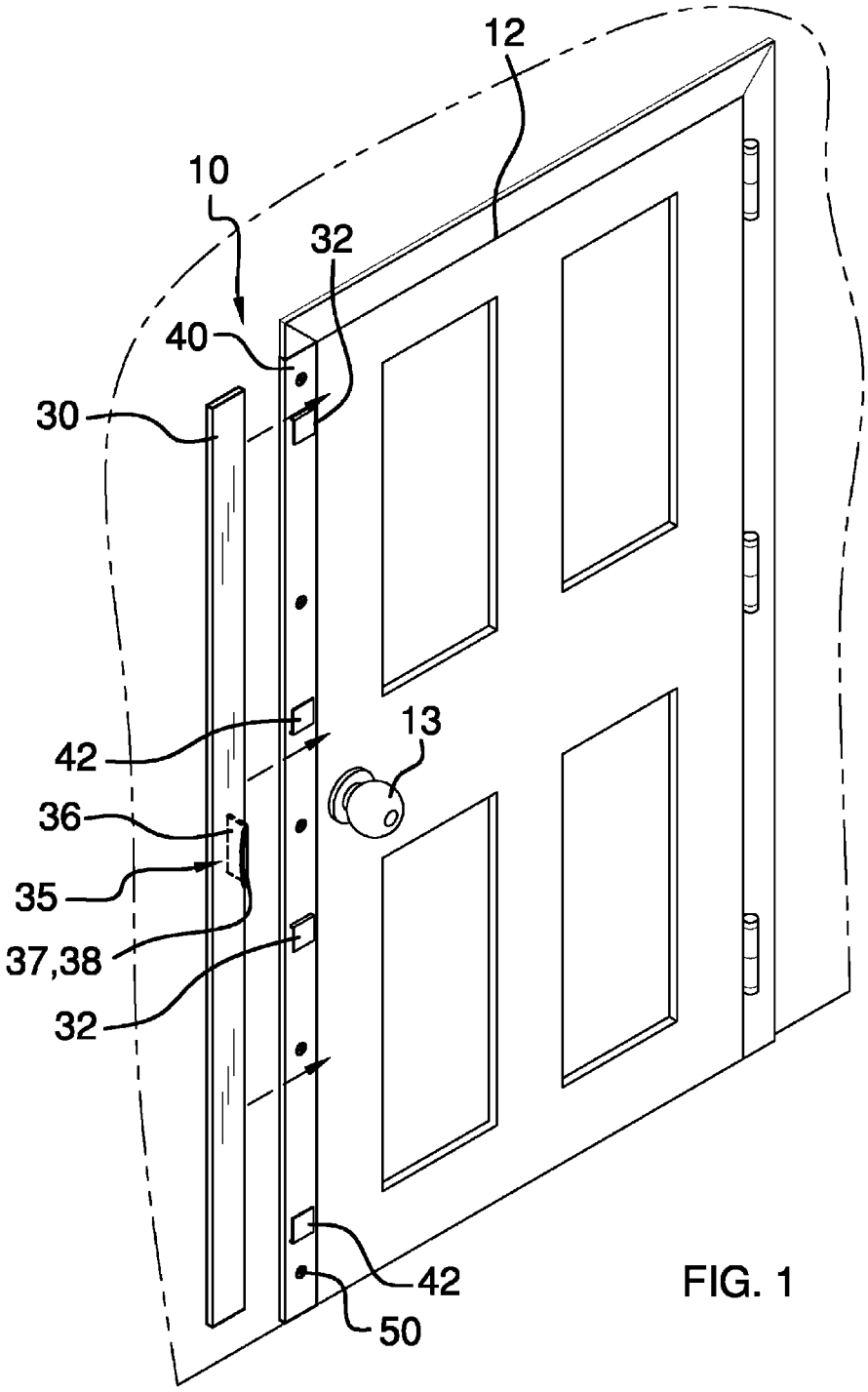
FIG. 1 is a perspective view of the device in relationship to an existing door.

Referring to FIG. 1, the device 10 partially comprises the trim 30 and the track 40. The trim 30 further comprises of a plurality of spaced apart male tabs 32 with each male tab 32 having a horizontal 33 connected to a downwardly disposed vertical 34 and a plurality of spaced apart female tabs 42 disposed alternately between the male tabs 32, with each female tab 42 having a horizontal 33 connected to an upwardly disposed vertical 34.

Figure 1A:
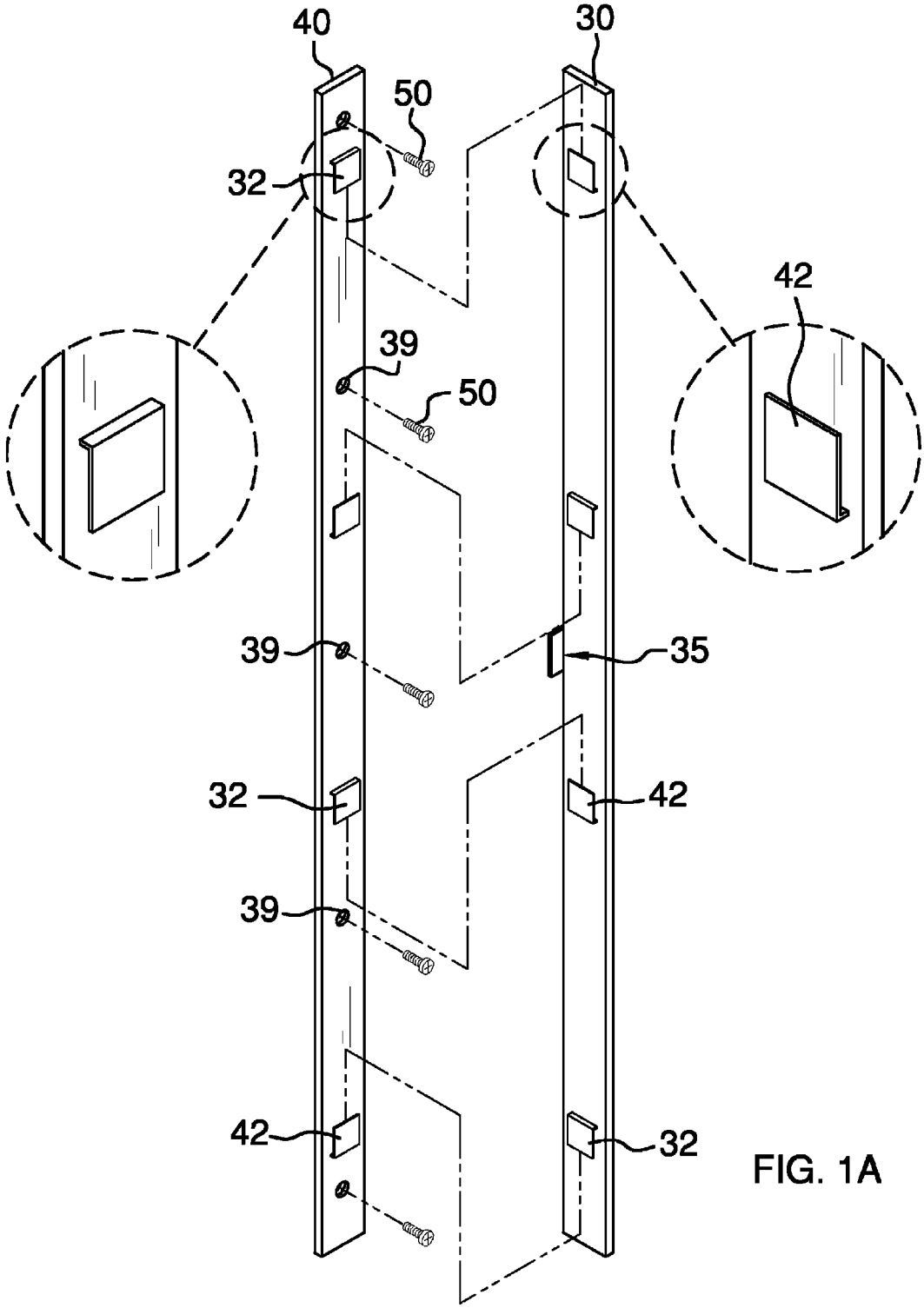
FIG. 1A is a perspective view.

Referring to FIG. 1A, the device 10 is presented as provided to a user.

Figure 4:
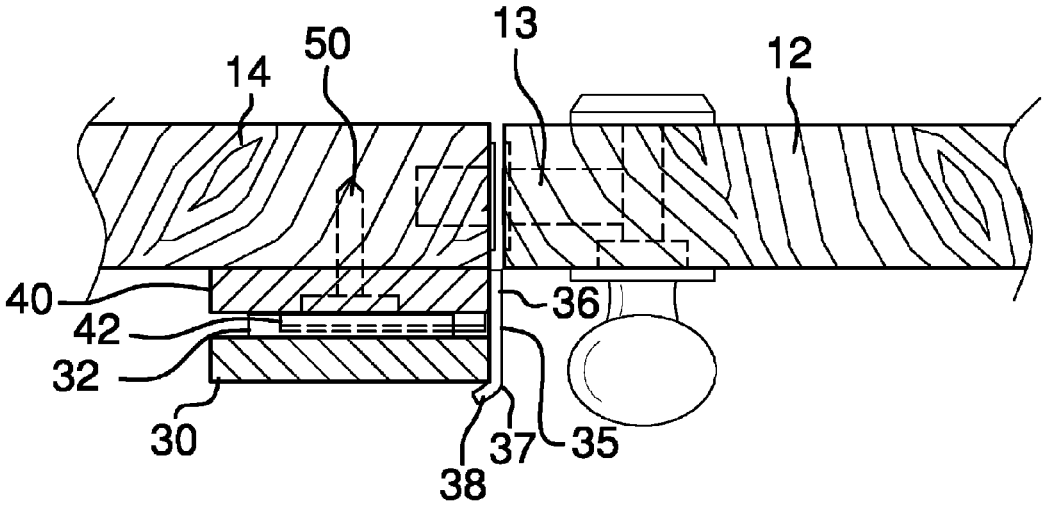
FIG. 4 is a cross sectional view of FIG. 2 with the device in an unlocked position, taken along the line 4-4.
Figure 5:
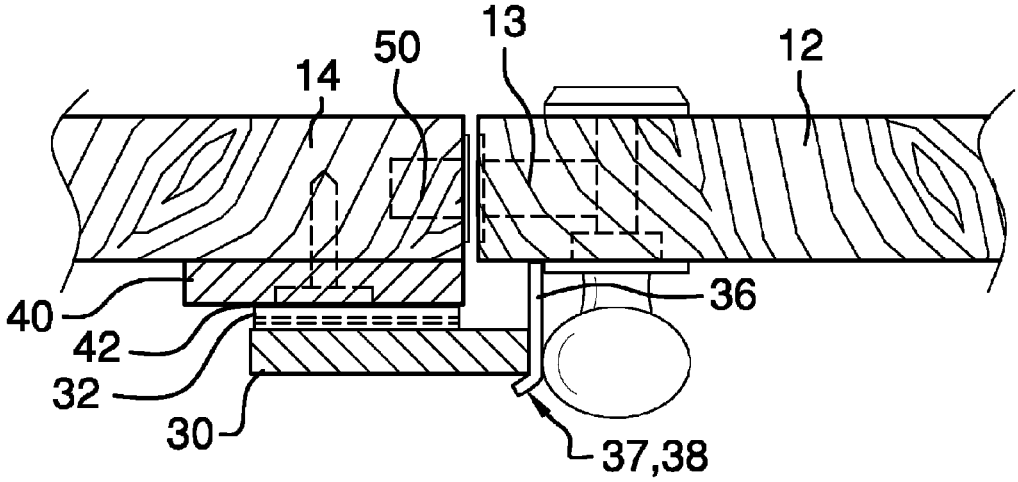
FIG. 5 is a cross sectional view of FIG. 3, taken along the line 5-5, with the device in a locked position.

Referring to FIG. 4 and FIG. 5, the handle 35 is disposed about centrally on the trim 30 between the top and the bottom. The handle 35 has an inwardly disposed handle extension 36 and an oppositely outwardly disposed bend 37 with u-shape 38. The track 40 further comprises of a plurality of spaced apart orifices 39 disposed between the top and the bottom, a plurality of fasteners 50 attaching the track 40 to an existing stud/jamb 14 via the orifices 39, and a plurality of spaced apart female tabs 42 with each female tab 42 having a horizontal 33 connected to a downwardly disposed vertical 34. A plurality of spaced apart male tabs 32 is disposed alternately between the female tabs 42 with each male tab 32 having a horizontal 33 connected to an upwardly disposed vertical 34.

Figure 6:
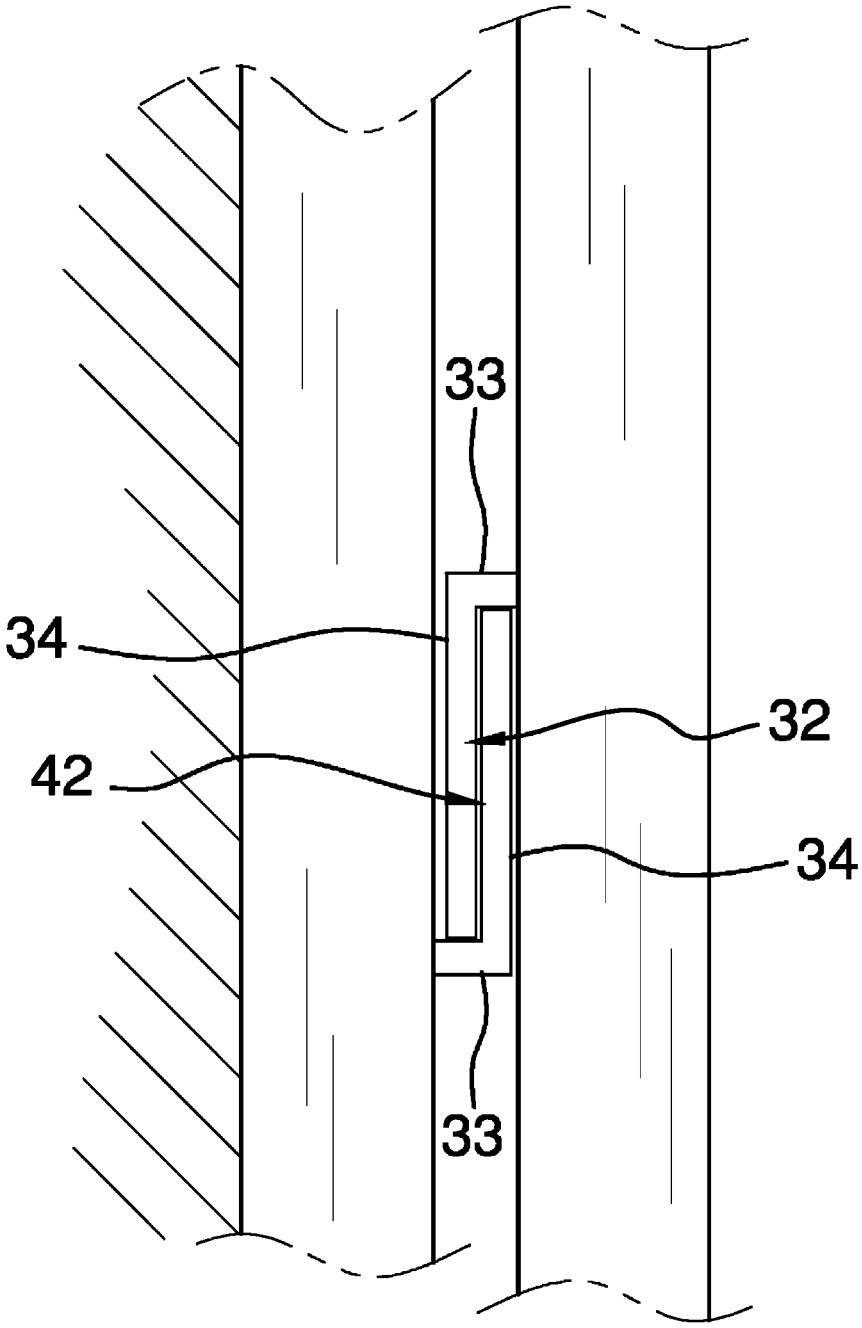
FIG. 6 is a lateral elevation view of the device in use, with engagement of the female and male lock tabs.

Referring to FIG. 6, the male tabs 32 and the female tabs 42 of the track 40 selectively engage the female tabs 42 and the male tabs 32 of the trim 30.

Figure 2:
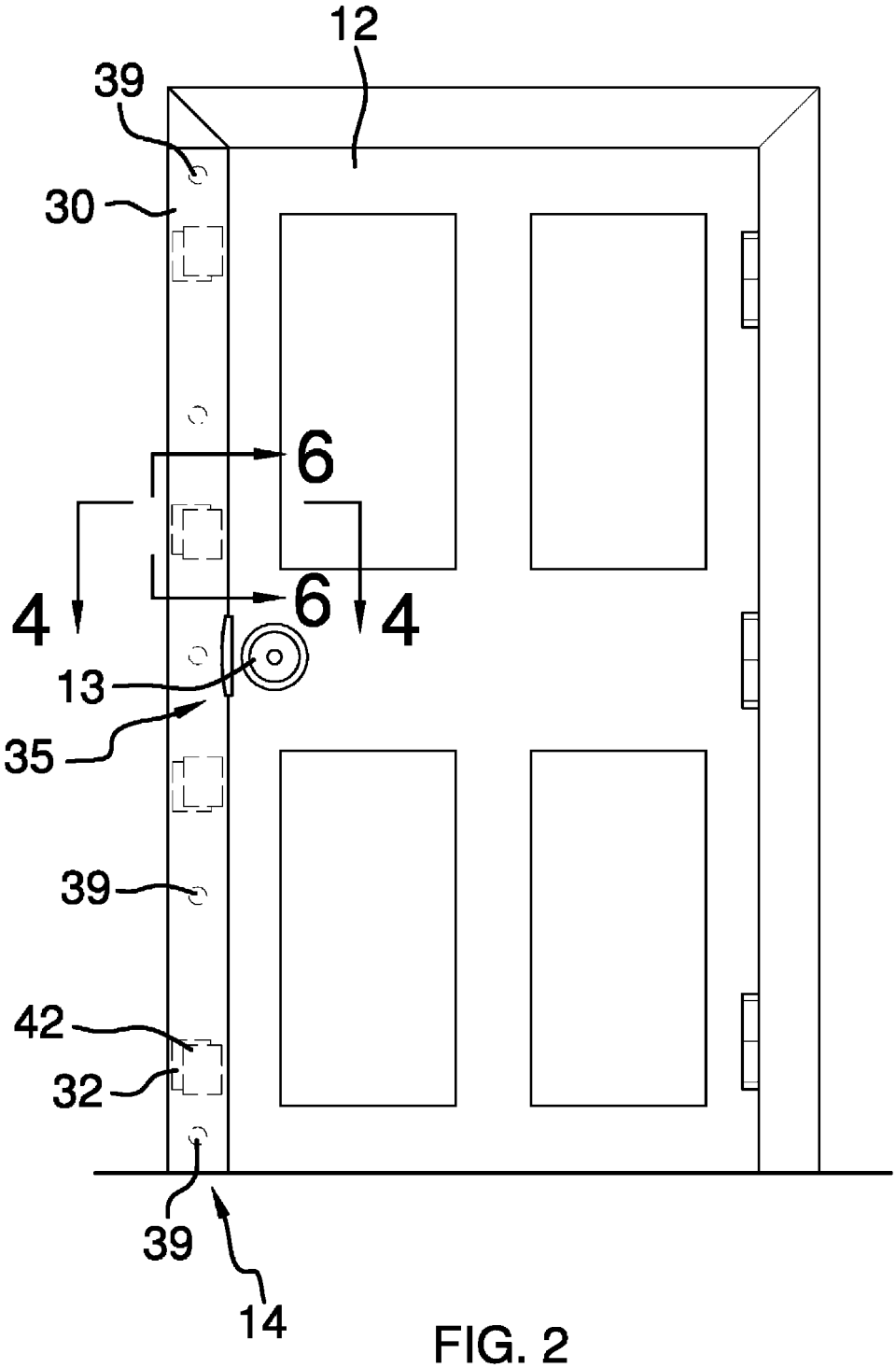
FIG. 2 is a front elevation view of the device affixed to an existing stud/jamb, the device in the unlocked position.

Referring to FIG. 2 and FIG. 4, the trim 30 is partially engaged with the track 40. The bend 37 and the u-shape 38 are moved away from the existing door 12 such that the trim 30 does not engage the existing door 12. The existing door 12 may thereby be opened.

Figure 3:
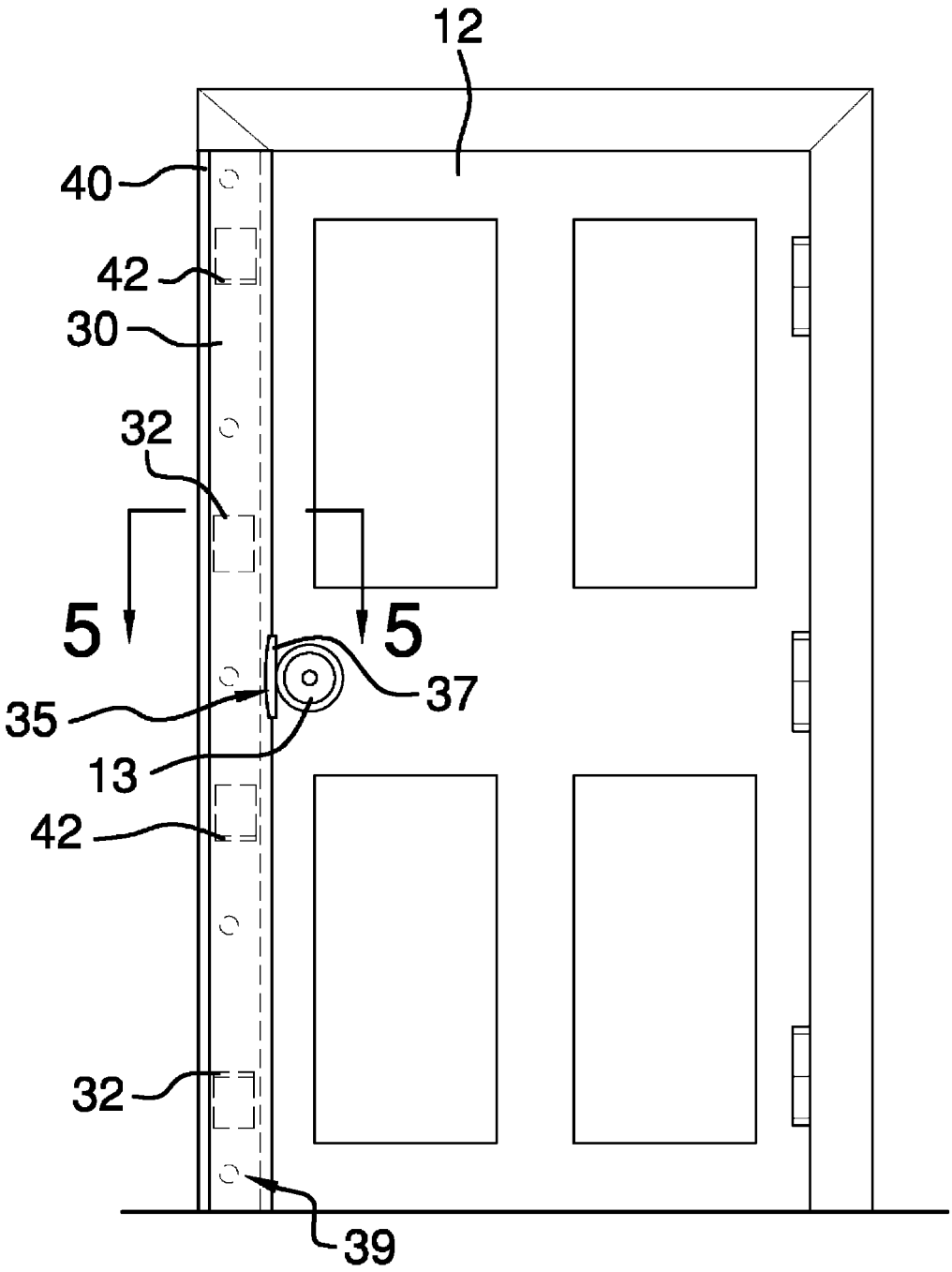
FIG. 3 is a front elevation view of the device affixed to an existing stud/jamb, the device in the locked position.

Referring to FIG. 3 and also to FIG. 5, the trim 30 may be virtually immediately abutted against the existing door 12 in preventing door 12 opening. The existing latch/lock mechanism 13 may be engaged and disengaged by a user and operates independently of the device 10.

Referring to FIGS. 4 and 5, the device 10 may be easily used in conjunction with existing latch/lock mechanisms 13.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the door security device may be used.

What is claimed is:

1. A door security device comprising, in combination:

a trim and a track, the trim further comprising:

a plurality of spaced apart male tabs, each male tab having a horizontal member that extends outwardly from the trim connected to a downwardly disposed vertical member, the vertical member distanced from the trim by the length of the horizontal member;

the track further comprising a plurality spaced apart female tabs, each female tab having a horizontal member that extends outwardly from the track connected to an upwardly disposed vertical member, the vertical member distanced from the trim by the length of the horizontal member, the track configured to be fastened to a stud/jamb of a door;

whereby the trim is engaged with the track via the tabs in an up or down vertical attachment; and wherein the trim is configured to engage with an existing door by moving the trim laterally with the trim remaining engaged with the track.

2. The device according to claim 1 wherein the male tabs and female tabs are equidistantly spaced apart.

3. A door security device comprising, in combination:

a trim and a track, the trim further comprising:

a first plurality of spaced apart male tabs, each male tab having a horizontal member that extends outwardly from the trim connected to a downwardly disposed vertical member, the vertical member distanced from the trim by the length of the horizontal member;

a first plurality of spaced apart female tabs disposed alternately between the male tabs, each female tab having a horizontal member that extends outwardly from the trim connected to an upwardly disposed vertical member, the vertical member distanced from the trim by the length of the horizontal member;

the track further comprising a second plurality of spaced apart female tabs, each female tab having a horizontal member that extends outwardly from the track connected to a downwardly disposed vertical member, the vertical member distanced from the track by the length of the horizontal member;

a second plurality of spaced apart male tabs disposed alternately between the female tabs, each male tab having a horizontal member that extends outwardly from the track connected to an upwardly disposed vertical member, the vertical member distanced from the track by the length of the horizontal member;

whereby the male tabs and the female tabs of the track selectively engage the female tabs and the male tabs of the trim in an up or down vertical attachment, the trim moved laterally with the tabs of the trim and track remaining engaged, the lateral movement of the trim thereby abutting the trim against an existing door in preventing an opening of the existing door.

4. A door security device comprising, in combination:

a trim and a track, the trim further comprising:

a first plurality of spaced apart male tabs, each male tab having a horizontal member that extends outwardly from the trim connected to a downwardly disposed vertical member, the vertical member distanced from the trim by the length of the horizontal member;

a first plurality of spaced apart female tabs disposed alternately between the male tabs, each female tab having a horizontal member that extends outwardly from the trim connected to an upwardly disposed vertical member, the vertical member distanced from the trim by the length of the horizontal member;

a handle disposed about centrally on the trim between the top and the bottom, the handle having an inwardly disposed handle extension and an oppositely outwardly disposed bend with u-shape;

the track further comprising a second plurality of spaced apart female tabs, each female tab having a horizontal member that extends outwardly from the track connected to a downwardly disposed vertical member, the vertical member distanced from the track by the length of the horizontal member;

a second plurality of spaced apart male tabs disposed alternately between the female tabs, each male tab having a horizontal member that extends outwardly from the trim connected to an upwardly disposed vertical member, the vertical member distanced from the track by the length of the horizontal member;

whereby the male tabs and the female tabs of the track selectively engage the female tabs and the male tabs of the trim in an up or down vertical attachment, the trim moved laterally and thereby abutted against an existing door in preventing an opening of the existing door.

5. The door security device of claim 1, further comprising the stud/jamb of the door.

6. The door security device of claim 5, further comprising the door.

7. The door security device of claim 1, further comprising the door.

8. The door security device of claim 3, further comprising the stud/jamb of the door.

9. The door security device of claim 8, further comprising the door.

10. The door security device of claim 3, further comprising the door.

11. The door security device of claim 4, further comprising the stud/jamb of the door.

12. The door security device of claim 11, further comprising the door.

13. The door security device of claim 4, further comprising the door.

14. The door security device of claim 3, further comprising a plurality of spaced apart orifices disposed between the top and the bottom; and a plurality of fasteners attaching the track to a stud/jamb via the orifices.

15. The door security device of claim 4, the track further comprising a plurality of spaced apart orifices disposed between the top and the bottom; and a plurality of fasteners attaching the track to a stud/jamb via the orifices.

* * * * *